US005834624A

United States Patent [19]

Nakagawa

[11] Patent Number: 5,834,624

[45] Date of Patent: Nov. 10, 1998

[54] AIR-FUEL RATIO DETECTING DEVICE AND METHOD THEREFOR

[75] Inventor: Norihisa Nakagawa, Numazu, Japan

[73] Assignee: Toyota Jidosha Kabushiki Kaisha, Aichi, Japan

[21] Appl. No.: 867,583

[22] Filed: Jun. 2, 1997

[30] Foreign Application Priority Data

Jun. 6, 1996 [JP] Japan ..... 8-144552

[51] Int. Cl.[6] ..... F02D 41/00

[52] U.S. Cl. ..... 73/23.32; 73/118.1; 123/686

[58] Field of Search ..... 73/23.31, 23.32, 73/116, 118.1; 123/685, 686, 689, 690, 704

[56] References Cited

U.S. PATENT DOCUMENTS

| | | | |
|---|---|---|---|
| 4,130,095 | 12/1978 | Bowler et al. . | |
| 4,348,727 | 9/1982 | Kobayashi et al. . | |
| 4,363,306 | 12/1982 | Sone et al. . | |
| 4,440,621 | 4/1984 | Kitahara et al. . | |
| 4,458,319 | 7/1984 | Chujo et al. . | |
| 4,592,325 | 6/1986 | Nakagawa . | |
| 4,729,220 | 3/1988 | Terasaka et al. . | |
| 4,751,907 | 6/1988 | Yamamoto et al. . | |
| 4,823,270 | 4/1989 | Nagai . | |
| 4,825,837 | 5/1989 | Hakagawa | 123/489 |
| 4,837,698 | 6/1989 | Amano et al. . | |
| 4,908,765 | 3/1990 | Murakami et al. . | |
| 4,915,813 | 4/1990 | Nakajima et al. . | |
| 4,993,392 | 2/1991 | Tanaka et al. | 73/23.32 |
| 5,053,968 | 10/1991 | Uchinami . | |
| 5,340,462 | 8/1994 | Suzuki . | |
| 5,394,857 | 3/1995 | Yamakawa | 123/491 |
| 5,473,889 | 12/1995 | Ehard et al. . | |
| 5,566,071 | 10/1996 | Akazaki et al. . | |
| 5,600,056 | 2/1997 | Hasegawa et al. . | |

FOREIGN PATENT DOCUMENTS 62-214249A 9/1987 Japan .

*Primary Examiner*—Ronald L. Biegel
*Assistant Examiner*—Eric S. McCall
*Attorney, Agent, or Firm*—Kenyon & Kenyon

[57] ABSTRACT

The device for detecting the air-fuel ratio in an internal combustion engine comprising an air-fuel ratio sensor arranged in an exhaust system of the engine and passes an electric current when an electric voltage is applied thereto, an air-fuel ratio sensor circuit that applies the electric voltage to the sensor, detects the current and outputs a signal proportional to the magnitude of the detected current, and a memory for storing a conversion map for calculating the air-fuel ratio in the engine corresponding to the output of the air-fuel ratio sensor circuit by the use of a reference air-fuel ratio sensor and the reference air-fuel ratio sensor circuit. The device further comprises: a sensor for determining the sensor inactive state when the difference between a first coolant temperature at the last engine stopped time and a second coolant temperature at the next engine start up time is equal to or more than a determined value; and a map for calibrating an air-fuel ratio in the engine calculated from the conversion map stored in the memory in response to the output from the sensor circuit based on the error between the output data of the sensor circuit when the sensor is determined to be in an inactive state by the sensor and the output data from the sensor circuit corresponding to the stoichiometric air-fuel ratio in the engine that is calculated from the conversion map, thereby correctly and very precisely detecting the air-fuel ratio.

3 Claims, 6 Drawing Sheets

AIR-FUEL RATIO DETECTING DEVICE AND METHOD THEREFOR

BACKGROUND OF THE INVENTION

1. Field of the Invention

The present invention relates to an air-fuel ratio detecting device and a method therefor and, particularly, to an air-fuel ratio detecting device and a method which correctly and very precisely detects the air-fuel ratio in an internal combustion engine used in both a very cold district and a very hot district.

2. Description of the Related Art

There has been known a linear air-fuel ratio sensor which is disposed in the exhaust system of an internal combustion engine (hereinafter referred to as an engine), detects the air-fuel ratio in the engine from the exhaust gas of the engine and generates an output which is proportional to the air-fuel ratio that is detected. In a device for controlling the air-fuel ratio by feedback with the use of the air-fuel ratio sensor according to a prior art, a map for calculating the air-fuel ratio in the engine corresponding to the output of the air-fuel ratio sensor is formed in advance through a bench test, the formed map is stored in a storage circuit, the air-fuel ratio in the engine is calculated from the map in response to the output of the air-fuel ratio sensor mounted on the real engine, and the air-fuel ratio in the engine is so controlled by feedback as to approach a target air-fuel ratio, for example, a stoichiometric air-fuel ratio at which the exhaust gas of the engine is best purified.

However, a processing circuit (hereinafter referred to as the air-fuel ratio sensor circuit or simply the sensor circuit) for processing the outputs from the air-fuel ratio sensor, used for the bench check to form the map for calculating the air-fuel ratio in the engine, is different from the processing circuit really used-in the engine. Therefore, the air-fuel ratio in the engine that is really detected involves an error, in other words, it does not serve as a correct value.

To solve the above problem, a technique to correctly and very precisely detect the air-fuel ratio in the engine by correcting an output error from the air-fuel ratio sensor circuit, has been proposed in Japanese Patent Application No. 7-12325. According to this technique, it is considered that an output of the sensor circuit when the air-fuel ratio sensor is in an inactive state equals an output of the sensor circuit when the air-fuel ratio is stoichiometric under the condition that the sensor is in an active state. Thus the output of the sensor circuit when the sensor is in an inactive state can be considered as the output of the sensor circuit corresponding to the stoichiometric air-fuel ratio when the sensor is in an active state, and correction can be made based on this output.

By the way, according to the above mentioned technique (Japanese Patent Application No. 7-12325), the inactive state of the air-fuel ratio sensor is determined based on the coolant temperature thw, for example, it is determined that the air-fuel ratio sensor is in an inactive state when thw≦30° C. However, when the sensor is used in a cold district, the air-fuel ratio sensor can be in an active state even though thw≦30° C., which causes improper correction. On the other hand, when the sensor is used in a hot district, the air-fuel ratio sensor can be in an inactive state even though thw>30° C., which fails to give a chance to correct the above mentioned output error.

SUMMARY OF THE INVENTION

The present invention has been made in view of the foregoing problems and it is therefore an object of the present invention to provide an air-fuel ratio detecting device and a method therefor which surely determines an inactive state of the air fuel ratio sensor and corrects the error in the output generated from the individual air-fuel ratio sensor circuit, thereby correctly and very precisely detecting the air-fuel ratio in the engine.

FIG. 1 is a block diagram showing the fundamental constitution according to the present invention. In FIG. 1, the part surrounded by broken lines is the air-fuel ratio detecting device 1 of the present invention.

In order to accomplish the above object, an air-fuel ratio detecting device 1 for detecting the air-fuel ratio in an internal combustion engine 10 is provided according to the first aspect of the present invention. The device 1 comprises an air-fuel-ratio sensor 20, an air-fuel ratio sensor circuit 30 and an air-fuel ratio detecting means 40 for detecting the air-fuel ratio in the engine based on the output from the sensor circuit 30.

In the air-fuel ratio detecting device 1, the air-fuel ratio sensor 20 is arranged in an exhaust system of the engine, passes an electric current when an electric voltage is applied thereto and is made from solid electrolyte. The air-fuel ratio sensor circuit 30 applies the electric voltage to the sensor 20 within a range of the limiting current, detects the concurrent limiting current and outputs a signal proportional to the magnitude of the detected current.

The air-fuel ratio detecting device is characterized in that it comprises: a sensor inactive state determining means A for determining that the sensor 20 is in an inactive state when the difference between a first coolant temperature thwg at the last engine stopped time and a second coolant temperature thw at the next engine start up time, is equal to or more than a determined value, for example, 30° C.; and an air-fuel ratio correcting means B for correcting the error existing in the air-fuel ratio in the engine detected by the air-fuel ratio detecting means 40 in response to the output of the sensor circuit 30 based on the output data of the sensor circuit 30 when the sensor 20 is determined that the sensor 20 is in an inactive state by the sensor inactive state determining means A.

The mode of operation of the air-fuel ratio detecting device according to the present invention will be explained below.

In the above air-fuel ratio detecting device 1, when a voltage is applied to the air-fuel ratio sensor 20 by the air-fuel ratio sensor circuit 30, the air-fuel ratio sensor 20 composed of a solid electrolyte disposed in the exhaust system of the engine passes an electric current that varies depending on the air-fuel ratio. The air-fuel ratio sensor circuit 30 generates an output that varies in proportion to the current. Referring to a conversion map previously stored in a storage for calculating an air-fuel ratio of an engine in response to the output of the air-fuel ratio sensor circuit 30, an air-fuel ratio corresponding to the output of the air-fuel ratio circuit 30 is read by the air-fuel ratio detecting means 40.

On the other hand, the sensor inactive state determining means A determines that the sensor 20 is in an inactive state when the difference between a first coolant temperature thwg at the last engine stopped time and a second coolant temperature thw at the next engine start up time, is equal to or more than a determined value, for example, 30° C., namely, the equation thwg−thw≧30° C. is satisfied.

The air-fuel ratio correcting means B corrects the error existing in the output from the sensor circuit 30 in real use corresponding to the air-fuel ratio based on the output data from the sensor circuit 30 at the time when the sensor 20 is determined that the sensor in an inactive state by the sensor inactive state determining means A.

To determine whether the air-fuel ratio sensor is in an inactive state, the relationship between the temperature decreasing rates of the engine coolant and the air-fuel ratio sensor is taken into consideration, and it is determined that the temperature in the air-fuel ratio sensor 20 has been decreased and the air-fuel ratio sensor has fallen into inactive state when the temperature decreasing amount in the coolant is equal to or more than the determined value.

After the error in the output from the air-fuel ratio sensor circuit 30 corresponding to the air-fuel ratio in the engine 10 is corrected by the air-fuel ratio correcting means B, the air-fuel ratio in the engine 10 is calculated in accordance with the corrected value by the air-fuel ratio detecting means 40 by, for example, using the above mentioned conversion map. Thus obtained air-fuel ratio is controlled to become a target ratio, for example, a stoichiometric air-fuel ratio by a fuel injection amount calculating means 50 that calculates the fuel injection amount in response to the engine operating conditions and supplies the calculated fuel amount to the engine 10.

In order to accomplish the object of the invention, an air-fuel ratio detecting device for detecting the air-fuel ratio in an internal combustion engine is provided according to the second aspect of the present invention. The device comprises an air-fuel ratio sensor arranged in an exhaust system of the engine, passes an electric current when an electric voltage is applied thereto and is made from solid electrolyte, an air-fuel ratio sensor circuit that applies the electric voltage to the sensor, detects the concurrent limiting current and outputs a signal proportional to the magnitude of the detected current, and a memory means for storing a conversion map formed in advance by the use of a reference air-fuel ratio sensor and the reference air-fuel ratio sensor circuit to calculate the air-fuel ratio in the engine corresponding to the output from the air-fuel ratio sensor circuit.

The device is characterized in that it comprises: a sensor inactive state determining means for determining the sensor inactive state when the difference between a first coolant temperature at the last engine stopped time and a second coolant temperature at the next engine start up time is equal to or more than a determined value; and a map calibrating means for calibrating the air-fuel ratio in the engine calculated from the conversion map stored in the memory means in response to the output from the sensor circuit based on the error between a first output data of the sensor circuit when the sensor is determined to be in an inactive state by the sensor inactive state determining means and a second output data calculated from the map as the output data from the sensor circuit corresponding to the stoichiometric air-fuel ratio in the engine.

In order to accomplish the above object, an air-fuel ratio detecting method for detecting the air-fuel ratio in an internal combustion engine in response to the output of an air-fuel ratio sensor circuit in real use that applies an electric voltage to a limiting current type air-fuel ratio sensor in real use within a range of the limiting current, detects the concurrent limiting current and outputs a signal proportional to the magnitude of the detected current, the air-fuel ratio sensor being arranged in an exhaust system of the engine, generates an electric current when an electric voltage is applied thereto and is made from solid electrolyte, wherein the method stores a conversion map in a memory means, the map being formed in advance by the use of a reference air-fuel ratio sensor and the reference air-fuel ratio sensor circuit, to calculate the air-fuel ratio in the engine corresponding to the output from the air-fuel ratio sensor circuit, is provided.

The method is characterized in that it comprises:

a first step for determining the sensor inactive state when the difference between a first coolant temperature at the last engine stopped time and a second coolant temperature at the next engine start up time is equal to or more than a determined value;

a second step for reading a first output data from the sensor circuit when it is determined that the sensor is in the inactive state;

a third step for reading a second output data calculated from the map as the output data from the sensor circuit corresponding to the stoichiometric air-fuel ratio in the engine;

a fourth step for calibrating the air-fuel ratio in the engine calculated from the conversion map in response to a third output data read from the air-fuel ratio sensor circuit based on the error between the first output data and the second output data.

BRIEF DESCRIPTION OF THE DRAWINGS

The present invention will be more clearly understood from the description as set forth below with reference to the accompanying drawings, wherein.

DESCRIPTION OF THE PREFERRED EMBODIMENTS

The preferred embodiments of the present invention will be described below with reference to the accompanying drawings.

Figure 1:
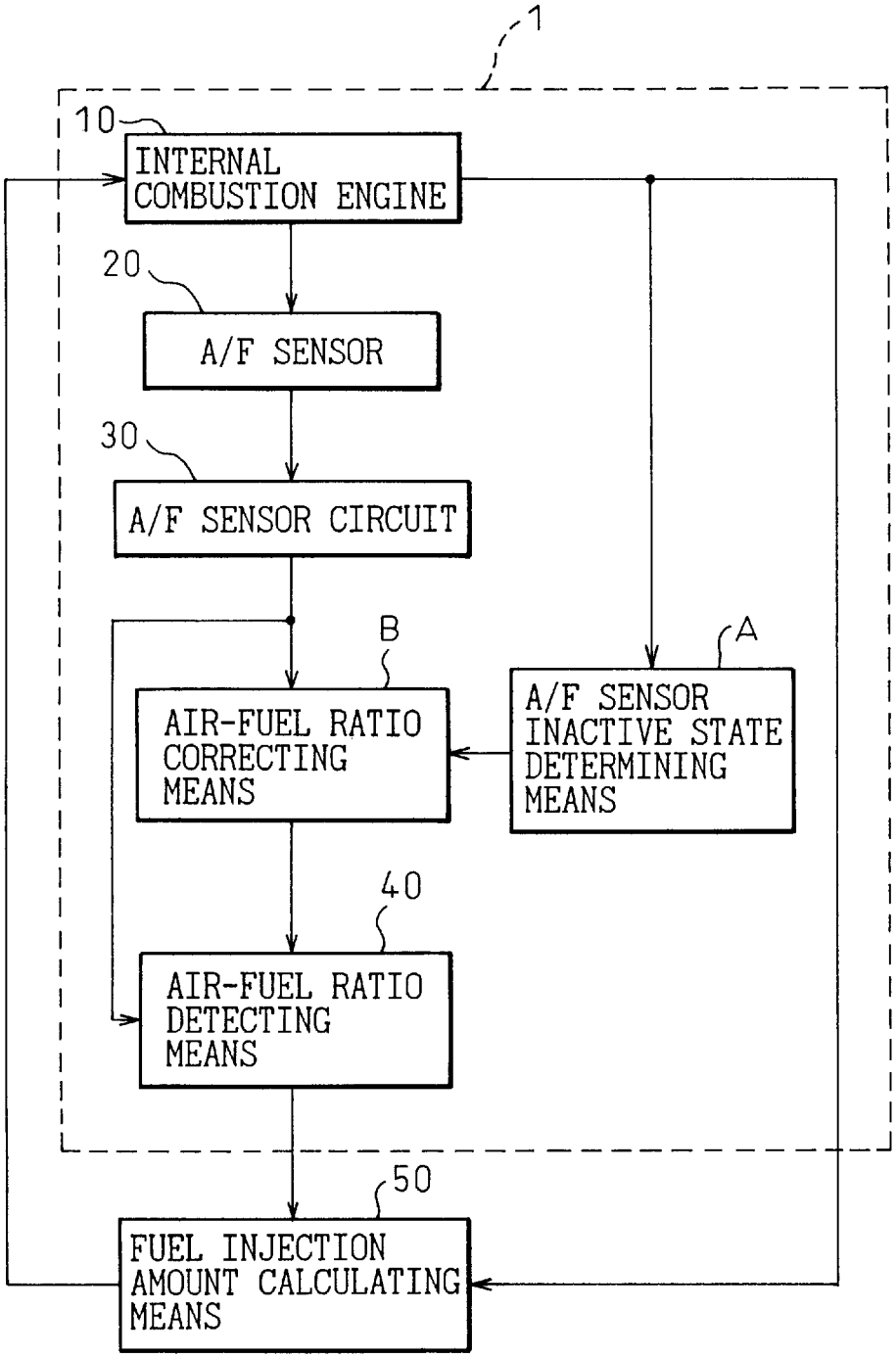
FIG. 1 is a block diagram showing the fundamental constitution according to the present invention.
Figure 2:
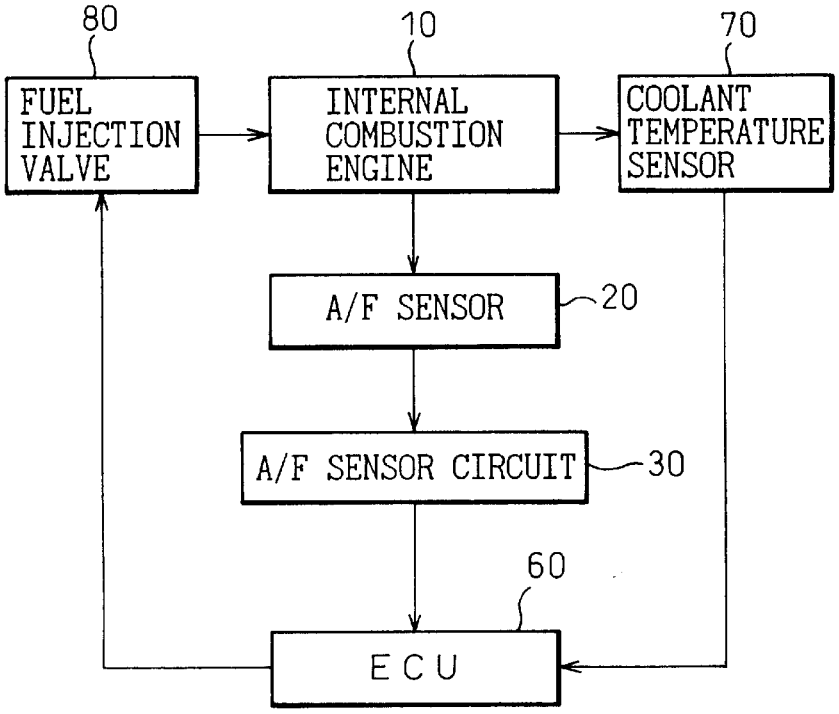
FIG. 2 is a block diagram showing the brief constitution of an embodiment according to the present invention.

FIG. 2 is a block diagram showing the brief constitution of an embodiment according to the present invention. The air-fuel ratio detecting means 40, the fuel injection amount calculating means 50, the sensor inactive state determining means A and the air-fuel ratio correcting means B explained with reference to FIG. 1 are performed by an electronic control unit (hereinafter ECU) 60 shown in FIG. 2 which executes routines explained later. The ECU 60 is, for example, made by a micro-processor system including a CPU, a RAM, a ROM, a first input interface, a second interface circuit and an output interface circuit. Analog signals from sensors are input to the second interface circuit via A/D converters not shown in FIG. 2. A coolant temperature sensor 70 embedded in an engine block (not shown) of the engine 10 detects the coolant temperature thw and outputs analog voltage proportional to the coolant temperature. This analog output voltage is input to one of the A/D converters in the ECU 60 and converted into the digital data. One of driving circuits in the output interface circuit is connected to a fuel injection valve 80 and opens the valve 80 for a period of time to inject the fuel injection amount calculated by the fuel injection amount calculating means 50 at each determined crank angle in response to a signal from a crank angle sensor (not shown).

Figure 3:
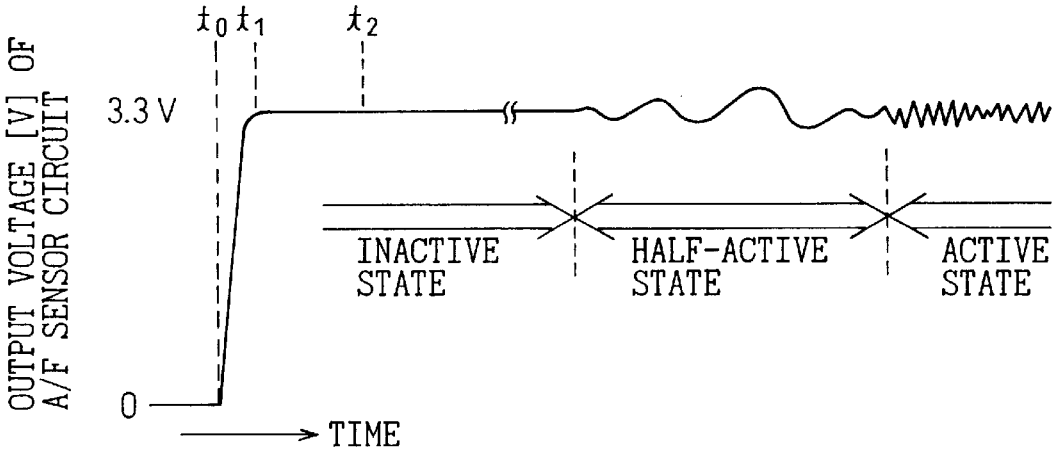
FIG. 3 is a diagram illustrating an output waveform of the air-fuel ratio sensor circuit immediately after the start of an engine.

FIG. 3 is a diagram illustrating an output waveform of the air-fuel ratio sensor circuit immediately after the start of an engine. In FIG. 3, the abscissa represents the time and the ordinate represents the output voltage of the air-fuel ratio sensor circuit. When the engine is started at a moment $t_0$, a voltage is applied from a battery to the air-fuel ratio sensor circuit and to the air-fuel ratio sensor, and the output voltage of the air-fuel ratio sensor circuit suddenly rises from 0 volt at the moment $t_0$ to 3.3 volts at a moment $t_1$, for example, 32 millisecond (hereinafter simply referred to ms) later. The output voltage of the air-fuel ratio sensor circuit remains constant at 3.3 volts as long as the air-fuel ratio sensor is in the inactive state. As the air-fuel ratio sensor becomes partially active, however, the output voltage fluctuates at a low frequency, with 3.3 volts as a center, as shown. Then, as the air-fuel ratio sensor becomes active, the output voltage fluctuates at a high frequency with 3.3 volts as a center. As described earlier, the output current generated by the air-fuel ratio sensor becomes zero when the exhaust gas detected by the air-fuel ratio sensor has the stoichiometric air-fuel ratio or when the air-fuel ratio sensor is in the inactive state. By reading the output voltage, for example, 3.3 volts, of the air-fuel ratio sensor circuit at the moment when the air-fuel ratio sensor is in the inactive state, it is possible to detect the output voltage, i.e., the stoichiometric voltage of the air-fuel ratio sensor circuit when the air-fuel ratio sensor has detected the exhaust gas of the engine having the stoichiometric air-fuel ratio. According to the present invention, as will be described later, the stoichiometric voltage is obtained by sampling an output voltage of the air-fuel ratio sensor circuit at every 32 ms, from, for example, the moment $t_0$ to a moment $t_2$ 640 ms later.

Figure 4:
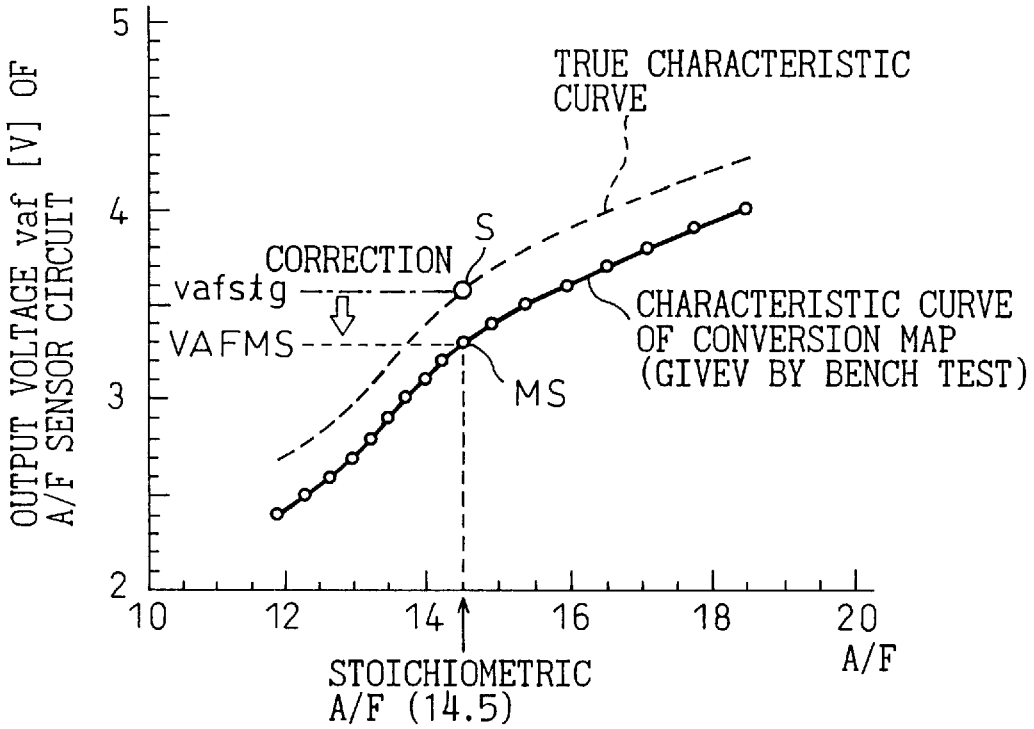
FIG. 4 is a diagram illustrating a conversion map of the air-fuel ratio in an internal combustion engine corresponding to the outputs of the air-fuel ratio sensor circuit.

FIG. 4 is a diagram illustrating a conversion map of the air-fuel ratio in an internal combustion engine corresponding to the outputs of the air-fuel ratio sensor circuit. In FIG. 4, the abscissa represents the air-fuel ratio ABF (A/F) in the engine detected by the air-fuel ratio sensor and the ordinate represents the output voltage vaf of the sensor circuit. In FIG. 4, a thick solid line represents a characteristic curve of the conversion map found in advance, by bench testing, in order to calculate the air-fuel ratios in the engine corresponding to the outputs of the sensor circuit. The data for forming the conversion map are measured in advance, by bench testing, by using a reference air-fuel ratio sensor and a reference air-fuel ratio sensor circuit, and are stored in the storage circuit, for example, ROM. In FIG. 4, a broken line represent a characteristic curve of an air-fuel ratio sensor circuit used in a real engine and formed in a manner as described below. The characteristic curve shown in FIG. 4 is somewhat exaggerated to ease understanding. First, a point S is plotted at which the output voltage vaf of the sensor circuit is equal to a stoichiometric voltage vafstg that is measured by using the sensor and the sensor circuit that are mounted on the real engine, and the air-fuel ratio is stoichiometric, i.e., 14.5.

Next, the point MS corresponding to the stoichiometric air-fuel ratio is plotted on a characteristic curve of a conversion map indicated by the solid thick line as shown in FIG. 4, and an output voltage VAFMS of the sensor circuit corresponding to the point MS is read. Then, a plurality of points on the characteristic curve of the conversion map are shifted and plotted in the direction of the axis of ordinate with the distance of vafstg−VAFMS, and a new characteristic curve of the conversion map for real use is created by connecting these plotted points with the broken line as shown in FIG. 4. The output voltage vaf of the sensor circuit corresponding to an air-fuel ratio, measured in the real engine, approximately coincides with the output voltage corresponding to the same air-fuel ratio, read from the newly created characteristic curve shown by the broken line. Therefore, an accurate air-fuel ratio in the real engine can be calculated by executing the steps of reading output voltage vaf of the sensor circuit, calculating the equation vaf−(vafstg−VAFMS), updating vaf by the results of the calculation vaf−(vafstg−VAFMS), and reading the air-fuel ratio corresponding to a point for the updated vaf, i.e., vaf−(vafstg−VAFMS), on the characteristic curve originally made by bench testing.

Figure 5:
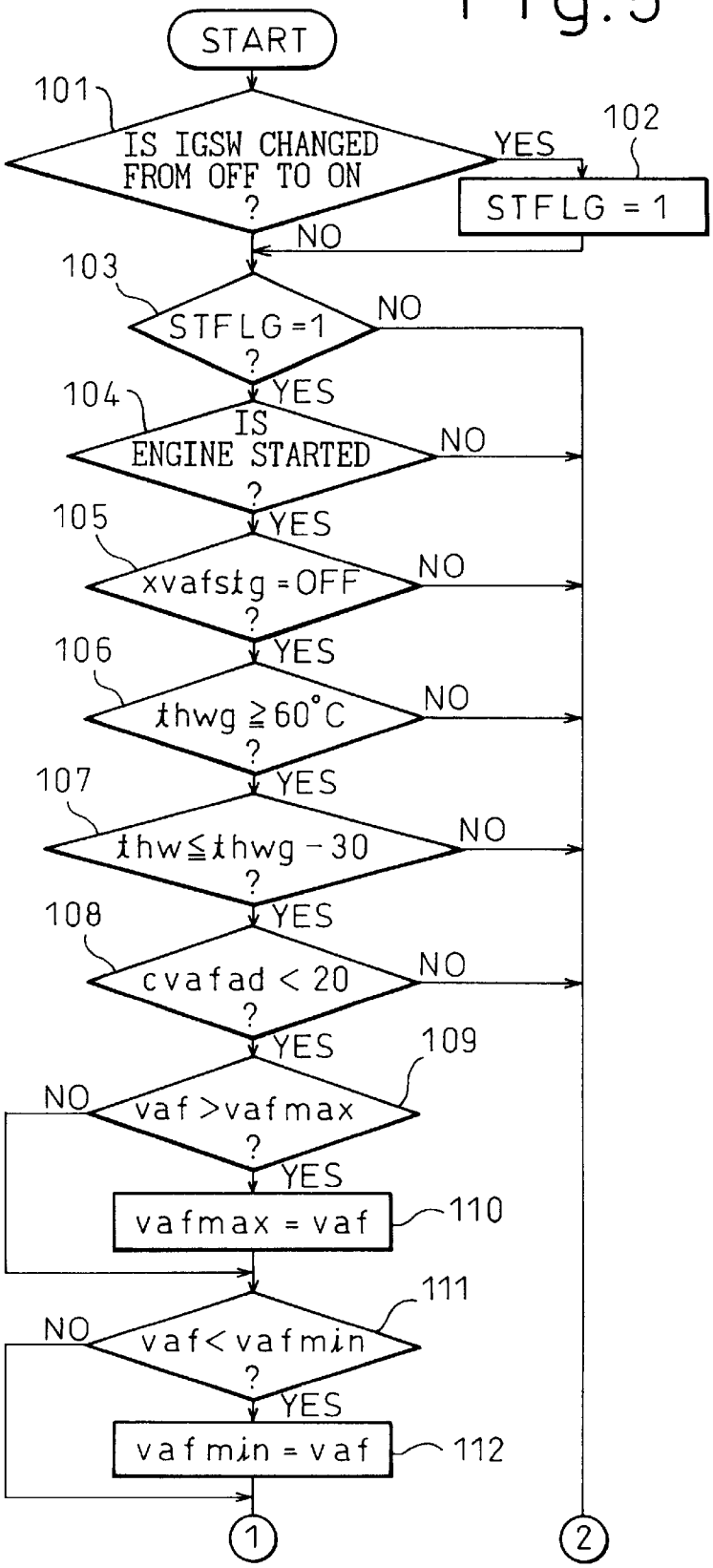
FIGS. 5 to 7 are parts of a flowchart showing a processing sequence of a routine for detecting an air-fuel ratio (A/F) from an air-fuel ratio sensor according to the present invention.
Figure 6:
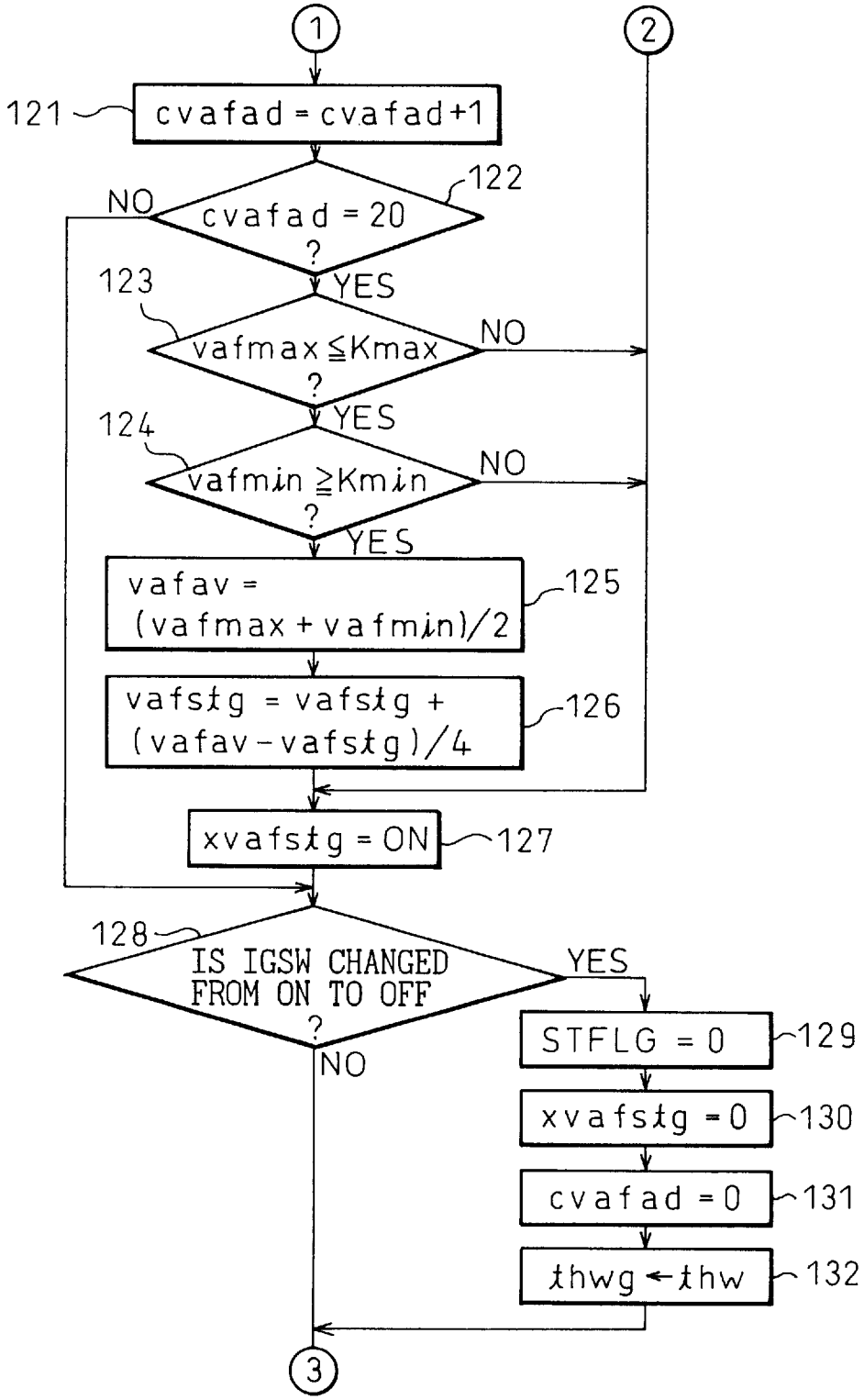
Figure 7:
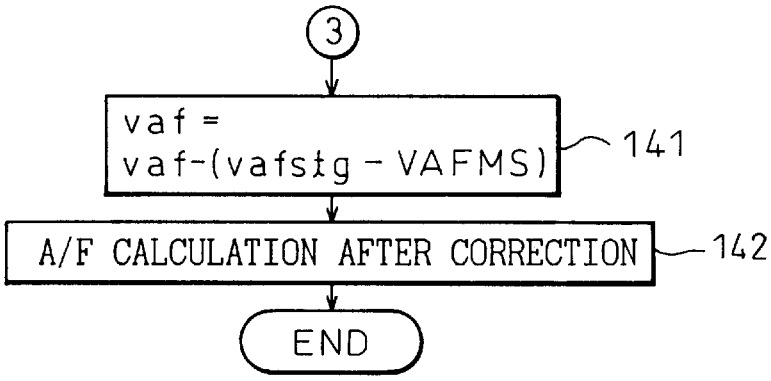

FIGS. 5 to 7 are parts of a flowchart showing a processing sequence of a routine for detecting an air-fuel ratio (A/F) from an air-fuel ratio sensor according to the present invention. The flowchart shown in FIGS. 5 and 6 relates to a routine for learning a stoichiometric air-fuel ratio (A/F) in response to the output of an air-fuel ratio sensor circuit in real use connected to an air-fuel ratio sensor in real use, and the flowchart shown in FIG. 7 relates to the routine for detecting the air-fuel ratio after executing the routine for learning the stoichiometric air-fuel ratio.

The A/F sensor inactive state determining means A for determining the sensor's inactive state according to the present invention can mainly be accomplished by executing the steps from 105 to 107 in FIG. 5, and the A/F correcting means B for correcting the output error of the sensor circuit 30 can mainly be accomplished by executing the steps from 109 to 126 in FIG. 5. The routine shown in FIGS. 5 to 7 can be executed every predetermined number of degrees in the crank angle of the engine, for example, every 180 degrees in crank angle (180° CA) or every predetermined period of time, for example, every 32 ms. In the present embodiment, the routine is executed every 32 ms.

First, in step 101, it is determined whether or not the ignition switch is changed over from off to on. If it is determined YES, the process proceeds to step 102, if it is determined NO, the process proceeds to step 103. In step 102, a start flag STFLG, preset to 0 at the engine start-up, is set to 1, then the process proceeds to step 103. In step 103, it is checked whether or not the start flag STFLG is set to 1, the process proceeds to step 104 when STFLG is 1, and process proceeds to step 127 when STFLG is 0. In step 104, it is determined whether or not the engine is started in accordance with the engine speed NE that is calculated from the output signal of a crank angle sensor, namely, it is determined that the engine is started when NE≧400 RPM and the process proceeds to step 105, and it is determined that the engine is not started when NE<400 RPM and the process proceeds to step 127.

In step 105, it is checked whether or not a stoichiometric learning prohibit flag xvafstg explained later is reset to 0. If xvafstg is 0, it is regarded that the stoichiometric learning is allowed to execute and the process proceeds to step 106. If xvafstg is 1, it is regarded that the stoichiometric learning is prohibited and the process proceeds to step 127.

In step 106, it is determined whether or not a coolant temperature learned value thwg stored in RAM when the engine is stopped last is equal to or greater than a determined temperature, for example, 60° C. If thwg≧60° C., it is regarded that the coolant temperature when the engine is stopped last indicates that the air-fuel ratio sensor is in an active state, and the process proceeds to step 107. If thwg<60° C., it is regarded that the coolant temperature when the engine is stopped last indicates that the air-fuel ratio sensor is in an inactive state, and the process proceeds to step 127.

Next, in step 107, it is determined whether or not the air-fuel ratio sensor is in an active state by comparing a coolant temperature thw read from the coolant sensor embedded in the engine block for detecting the engine temperature with the coolant temperature learned value thwg. That is, it is determined whether or not thw≦thwg−30 is true. This is equivalent to determining whether or not the coolant temperature thw when the engine is started this time is decreased more than 30 degrees from the coolant temperature learned value thwg read when the engine is stopped last. If the sufficiently long time passed from the previous engine stop time to the current engine start-up time, the coolant temperature thw decreases more than 30 degrees over the coolant temperature learned value thwg so that it is regarded that the temperature of the air-fuel ratio sensor is also decreased and the sensor has fallen into an inactive state.

Thus, if thw≦thwg−30 in step 107, it is regarded that the air-fuel ratio sensor is in inactive state and the process proceeds to step 108, while if thw>thwg−30 in step 107, it is regarded that the air-fuel ratio sensor is in an active state and the process proceeds to step 127. In this way, according to the above explained process, the relationship between the temperature decreasing rates of the engine coolant and the air-fuel ratio sensor is taken into consideration, and it is regarded that the air-fuel ratio sensor has fallen into an inactive state if the engine coolant temperature decreases more than the predetermined value, the temperature of the air-fuel ratio sensor decreases a large amount and the sensor has fallen into an inactive state.

In step 108, it is checked whether or not the number (cvafad) counted by a counter that counts the number of readouts of the output from the air-fuel ratio sensor circuit after the ignition switch is changed from OFF to ON, is less than a determined value, for example, 20. If the number cvafad<20, the process proceeds to step 109. If the number cvafad≧20, the process proceeds to step 127. By setting the determined value 20, whether 640 ms has passed or not since after the ignition switch is changed from OFF to ON can be checked because the processing cycle of this routine is 32 ms. For 640 ms after the ignition switch is changed from OFF to ON, it is determined whether or not the output value vaf of the air-fuel ratio sensor circuit in this processing cycle is greater than the maximum output value vafmax of the air-fuel ratio sensor circuit in step 109, and it is determined whether or not the output value vaf is smaller than the minimum output value vafmin of the air-fuel ratio sensor circuit in step 111. If vaf>vafmax in step 109, vafmax is replaced by the current vaf in step 110. If vaf≦vafmax in step 109, the process proceeds to step 111. If vaf<vafmin in step 111, vafmin is replaced by the current vaf in step 112. If vaf≧vafmin in step 111, the process proceeds to step 121.

Next, in step 121, the readout counter for counting the readout number (cvafad) of the output from the air-fuel ratio sensor circuit is counted up one, namely, cvafad=cvafad+1 is calculated, then the process proceeds to step 122. In step 122, it is determined whether or not the readout cvafad of the counter is equal to the determined value 20, namely, it is determined whether or not 640 ms has just passed in this processing cycle since after the ignition switch is changed from OFF to ON. If cvafad=20 in step 122, it is determined that this processing cycle is 640 ms after the ignition switch is changed from OFF to ON, and steps 123 to 127 for executing the stoichiometric air-fuel ratio learning arithmetic processes are performed. If cvafad≠20 in step 122, the process proceeds to step 128.

In step 123, it is determined whether or not the maximum output value vafmax of the air-fuel ratio sensor circuit is within the maximum acceptable value Kmax. If vafmax≦Kmax, it is determined that vafmax is equal to or less than an acceptable value of Kmax, and the process proceeds to step 124. If vafmax>Kmax, it is determined that vafmax is not an acceptable value, and the process proceeds to step 127. In step 124, it is determined whether or not the minimum output value vafmin of the air-fuel ratio sensor circuit is equal to or greater than a minimum acceptable value of Kmin. If vafmin≦Kmin, it is determined that vafmin is within the acceptable value Kmin, and the process proceeds to step 125. If vafmin<Kmin, it is determined that vafmin is not an acceptable value, and the process proceeds to step 127. In this way, after it is confirmed that both the maximum output value vafmax and the minimum output value vafmin are acceptable values, the center value vafav is calculated in step 125 in accordance with the following equation:

$$vafav=(vafmax+vafmin)/2$$

Next, in step 126, the stoichiometric air-fuel ratio learned value vafstg is calculated in accordance with the following equation:

$$vafstg=vafstg+(vafav-vafstg)/4$$

Then, in step 127, the stoichiometric learning prohibit flag xvafstg is set to 1. In the embodiment of the present invention, the maximum acceptable value Kmax for the output of the air-fuel ratio sensor circuit is set to 3.35 volts given by adding 0.5 volts to the standard stoichiometric air-fuel ratio voltage 3.30 volts, while the minimum acceptable value Kmin for the output of the air-fuel ratio sensor circuit is set to 3.25 volts given by deducting 0.5 volts from the standard stoichiometric air-fuel ratio voltage 3.30 volts. In the embodiment of the present invention, the preset value for the maximum output value vafmax of the air-fuel ratio sensor circuit is 3.35 volts, while the minimum output value vafmin for the air-fuel ratio sensor circuit is 3.25 volts. These preset values may be set 5 volts and 0 volt correspondingly. With regard to the preset value of the stoichiometric air-fuel ratio learned value vafstg can be set to 3.3 volts.

In step 128, whether or not the ignition switch is changed over from ON to OFF is determined. If the result is YES in step 128, the process proceeds to step 129. If the result is NO in step 128, the process proceeds to step 141. In step 129, the start flag STFLG is reset to 0. Then, the stoichiometric leaning prohibit flag xvafstg is reset to 0 in step 130, the number cvafad counted by the readout counter is reset to 0 in step 131, and the coolant temperature learned value thwg is replaced by the coolant temperature thw read in step 132 of the current processing cycle that is stored as the coolant temperature at the time when the engine is stopped from the running state last. Then, the process proceeds to step 141.

Referring to FIG. 7, the air-fuel ratio calculation processes according to the present invention will be explained. In step 141, a process for calibrating the conversion map for calculating the air-fuel ratio in the engine in response to the output from the air-fuel ratio sensor circuit in real use connected to the air-fuel sensor in real use is provided. In step 142, a process for correctly and very precisely calculating the air-fuel ratio with the use of thus created conversion map is provided. The detail of these processes will be explained below.

In step 141, the output voltage vaf of the air-fuel ratio sensor circuit is calculated in accordance with the following equation:

$$vaf=vaf-(vafstg-VAFMS)$$

wherein vaf represents output voltage from the air-fuel ratio sensor circuit read in the current processing cycle, vafstg represents the stoichiometric learned value obtained in step 126 that corresponds to the stoichiometric air-fuel ratio voltage for the air-fuel ratio sensor circuit in real use, and VAFMS represents the output voltage from the reference air-fuel ratio sensor circuit corresponding to the stoichiometric air-fuel ratio, for example, 14.5, on the conversion map previously formed in the bench test with the use of the reference air-fuel ratio sensor and the reference air-fuel ratio sensor circuit.

In step 142, the air-fuel ratio of the engine corresponding to the output voltage vaf of the air-fuel ratio sensor circuit obtained in step 141 is calculated after correction based on the conversion map shown in FIG. 4. The step 142 indicates that a real characteristic curve shown by a broken line in FIG. 4 can be obtained by shifting (vafstg−VAFMS) from the characteristic curve shown by a solid line in FIG. 4 which is previously formed by the aforementioned bench test.

As heretofore explained, according to the air-fuel ratio detecting device and the method of the present invention, the air-fuel ratio in the combustion engine can be correctly and very precisely detected in both cold and hot districts because the present invention surely determines an inactive state of the air fuel ratio sensor and corrects errors in the output caused by the individual air-fuel ratio sensor circuit.

Furthermore, according to the air-fuel ratio detecting device and the method of the present invention, the exhaust gas of the engine can be purified by controlling the amount of the fuel injection based on the air-fuel ratio detected by the air-fuel ratio detecting device.

According to the air-fuel ratio detecting devise and the method of the present invention, which calibrates the conversion map while the engine is in operation depending upon the output characteristics of the air-fuel ratio circuit mounted on a real engine, no step is required for calibrating the map at the time of shipment of the real engine.

It will be understood by those skilled in the art that the foregoing description is a preferred embodiment of the disclosed device and that various changes and modifications may be made in the invention without departing from the spirit and scope thereof.

I claim:

1. An air-fuel ratio detecting device for detecting the air-fuel ratio in an internal combustion engine comprising an air-fuel ratio sensor arranged in an exhaust system of the engine, passes an electric current when an electric voltage is applied thereto and is made from solid electrolyte, an air-fuel ratio sensor circuit that applies the electric voltage to the sensor, detects a concurrent limiting current and outputs a signal proportional to the magnitude of a detected current, and an air-fuel ratio detecting means for detecting the air-fuel ratio in the engine based on the output from the sensor circuit, the air-fuel ratio detecting device comprising:

a sensor inactive state determining means for determining the sensor inactive state when a difference between a first coolant temperature at a last engine stopped time and a second coolant temperature at a next engine start up time is equal to or more than a determined value; and an air-fuel ratio correcting means for correcting an error existing in the air-fuel ratio in the engine detected by the air-fuel ratio detecting means in response to the output of the sensor circuit based on the output data of the sensor circuit when the sensor is determined to be in an inactive state by the sensor inactive state determining means.

2. An air-fuel ratio detecting device for detecting the air-fuel ratio in an internal combustion engine comprising an air-fuel ratio sensor arranged in an exhaust system of the engine, passes an electric current when an electric voltage is applied thereto and is made from solid electrolyte, an air-fuel ratio sensor circuit that applies the electric voltage to the sensor, detects a concurrent limiting current and outputs a signal proportional to the magnitude of a detected current, and a memory means for storing a conversion map formed in advance by use of a reference air-fuel ratio sensor and a reference air-fuel ratio sensor circuit to calculate the air-fuel ratio in the engine corresponding to the output from the air-fuel ratio sensor circuit, the air-fuel ratio detecting device comprising:

a sensor inactive state determining means for determining the sensor inactive state when a difference between a first coolant temperature at a last engine stopped time and a second coolant temperature at a next engine start up time is equal to or more than a determined value; and a map calibrating means for calibrating the air-fuel ratio in the engine calculated from the conversion map stored in the memory means in response to the output from the sensor circuit based on an error between a first output data of the sensor circuit when the sensor is determined to be in an inactive state by the sensor inactive state determining means and a second output data calculated from the map as the output data from the sensor circuit corresponding to a stoichiometric air-fuel ratio in the engine.

3. An air-fuel ratio detecting method for detecting the air-fuel ratio in an internal combustion engine in response to an output of an air-fuel ratio sensor circuit in real use that applies an electric voltage to a limiting current type air-fuel ratio sensor in real use within a range of the limiting current, detects a concurrent limiting current and outputs a signal proportional to the magnitude of the detected current, the air-fuel ratio sensor being arranged in an exhaust system of the engine, generates an electric current when an electric voltage is applied thereto and is made from solid electrolyte, wherein the method stores a conversion map in a memory means, the map being formed in advance by use of a reference air-fuel ratio sensor and a reference air-fuel ratio sensor circuit to calculate the air-fuel ratio in the engine corresponding to the output from the air-fuel ratio sensor circuit, and the air-fuel ratio detecting method comprising:

a first step for determining a sensor inactive state when a difference between a first coolant temperature at a last engine-stopped time and a second coolant temperature at a next engine start up time is equal to or more than a determined value;

a second step for reading a first output data from the sensor circuit when a determination is made that the sensor is in an inactive state;

a third step for reading a second output data calculated from the map as the output data from the sensor circuit corresponding to a stoichiometric air-fuel ratio in the engine;

a fourth step for calibrating the air-fuel ratio in the engine calculated from the conversion map in response to a third output data read from the air-fuel ratio sensor circuit based on an error between the first output data and the second output data.

* * * * *